US006808101B2

(12) United States Patent
Laubach et al.

(10) Patent No.: US 6,808,101 B2
(45) Date of Patent: Oct. 26, 2004

(54) FRAMING TOOL WITH AUTOMATIC FASTENER-SIZE ADJUSTMENT

(75) Inventors: Marco Laubach, Gurnee, IL (US); Barry Walthall, Wheeling, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/155,456

(22) Filed: May 24, 2002

(65) Prior Publication Data

US 2003/0218044 A1 Nov. 27, 2003

(51) Int. Cl.[7] ..... B25C 1/04

(52) U.S. Cl. ..... 227/109; 227/119; 227/120; 227/136

(58) Field of Search ..... 227/120, 109, 227/119, 136

(56) References Cited

U.S. PATENT DOCUMENTS

| | | | | |
|---|---|---|---|---|
| 3,491,932 A | | 1/1970 | Novak | |
| 3,834,602 A | * | 9/1974 | Obergfell | 227/109 |
| 3,892,313 A | | 7/1975 | Lange | |
| 4,597,517 A | | 7/1986 | Wagdy | |
| 4,815,647 A | * | 3/1989 | Chou | 227/109 |
| 4,858,812 A | | 8/1989 | Fealey | |
| 5,096,109 A | | 3/1992 | Chen | |
| 5,238,167 A | | 8/1993 | Howard et al. | |
| 5,297,713 A | | 3/1994 | Perra et al. | |
| 5,322,189 A | * | 6/1994 | Oda | 227/120 |
| 5,335,800 A | * | 8/1994 | Liu | 227/120 |
| 5,437,404 A | * | 8/1995 | Shkolnikov | 227/109 |
| 5,452,835 A | | 9/1995 | Shkolnikov | |
| 6,006,975 A | | 12/1999 | Ishizawa | |
| 6,053,389 A | * | 4/2000 | Chu et al. | 227/119 |
| 6,279,808 B1 | | 8/2001 | Larsen | |

FOREIGN PATENT DOCUMENTS

| | | |
|---|---|---|
| EP | 0 014 725 | 9/1980 |
| WO | 01/010603 | 2/2001 |

* cited by examiner

*Primary Examiner*—Scott A. Smith
(74) *Attorney, Agent, or Firm*—Lisa M. Soltis; Mark W. Croll; Donald J. Breh

(57) ABSTRACT

A tool has an improved nosepiece and shear block assembly that drives a fastener supplied from a plurality of fasteners. The assembly includes a nosepiece that is configured for attachment to the tool and defines a portion of a barrel and a shear block configured to be secured to the nosepiece to complete the barrel. There is an opening in barrel has for receiving a fastener. The assembly also includes a biased fastener-size adjustment device, which exerts a biasing force against fasteners adjacent the opening.

13 Claims, 5 Drawing Sheets

FRAMING TOOL WITH AUTOMATIC FASTENER-SIZE ADJUSTMENT

FIELD OF THE INVENTION

This invention relates generally to improvements in fastener driving tools, and specifically to such tools designed to utilize fastener of varying sizes. The present tool automatically adjusts to different sized fasteners to reduce jamming, making the tools easier to use and having more accurate fastener delivery.

BACKGROUND OF THE INVENTION

Power framing tools for use in driving fasteners into workpieces are well known. The framing tools are usually portable and are powered pneumatically or by combustion. Similar pneumatic tools are described in U.S. Pat. Nos. 4,932,480; 3,552,274 and 3,815,475, all of which are incorporated by reference. Combustion powered tools are described in commonly assigned patents to Nikolich, U.S. Pat. Nos. Re. 32,452; 4,403,722; 4,483,473; 4,483,474; 4,552,162; 5,197,646 and 5,263,439, all of which are incorporated herein by reference. Such combustion powered tools particularly designed for trim applications are disclosed in commonly assigned U.S. Pat. No. 6,016,622, also incorporated by reference herein. Similar combustion powered nail and staple driving tools are available from ITW-Paslode under the IMPULSE® brand.

Such tools incorporate a generally pistol-shaped tool housing enclosing the power source, such as a pneumatic cylinder or a small internal combustion engine. The engine is powered by a canister of pressurized fuel gas also called a fuel cell. Power is generated from expansion of compressed gasses, either by burning of fuel in a combustion chamber or expansion of air in the pneumatic cylinder. The power source moves a reciprocating piston having an elongate, rigid driver blade disposed within a piston chamber of a cylinder body. A safety interlock prevents firing of the tool unless a workpiece contact element at the end of a nosepiece, or nosepiece assembly, is pressed against a workpiece.

Upon the pulling of a trigger, gas or air expansion causes the piston and the driver blade to be shot downward to impact a positioned fastener and drive it into the workpiece. As the piston is driven downward, a displacement volume enclosed in the piston chamber below the piston is forced to exit through one or more exit ports provided at a lower end of the cylinder. After impact, the piston then returns to its original or "ready" position through differential gas pressures within the cylinder. Fasteners are fed into the nosepiece barrel from a supply assembly, such as a magazine, where they are held in a properly positioned orientation for receiving the impact of the driver blade. The fasteners are then propelled through the length of the barrel by the driver blade, exiting the barrel at the workpiece surface. Force of the driver blade and the momentum of the fastener drives the fastener to penetrate the workpiece.

Framing tools are commonly used in residential construction primarily for driving nails into wood. Metal hardware pieces, such as joist hangers, connecting plates and seismic strapping are frequently attached to the wood framing requiring relatively accurate placement of the fastener in openings or slots in the metal hardware. A POSITIVE PLACEMENT® tool is a specialty framing tool that is used where accurate placement of the fastener is desirable. This tool has a probe that aids alignment of the fastener with the hardware openings.

At least two different lengths of nail, 1½" and 2½", are typically used for these applications. Current designs for these tools require the user to change settings on the tool when changing between different nail lengths. The user must first pull on a spring-biased plunger to disengage it from a rebound lever. The rebound lever pivots approximately 60 degrees about a pin. While holding the plunger in the outward position, the lever must be rotated via the handle to the other position. When the plunger is released, it again engages with the lever to lock it into the new position. Such an operation requires two hands, one to hold the tool and the other pull the plunger, rotate it and allow it to reengage. In construction environments, the user is often in an inconvenient place, trying to align two or more workpieces to be fastened together. It is not always practical to free both hands to effect the setting change.

In currently available tools, there is also no mechanism for prohibiting the user from loading short nails into the magazine when the lever is set for the long nails. When set for long nails, there is a longer opening to the nosepiece permitting entry of the nail. If the tool is operated in this condition, the short nails can rotate before they travel the length of the opening, causing a jam. The driving mechanism can become wedged between the nail and the nosepiece, causing it to become stuck and rendering the tool inoperable. This condition has been the cause of many field failures of the tool.

Rotation or tumbling of a short nail as it is being driven also leads to inaccuracies in the flight of the nail. Dimensional differences of the fasteners allow more freedom of movement of smaller fasteners within the barrel. Lateral movement of the nail as it travels down the barrel permits the nail to exit the barrel at random orientations compared with the vertical axis of the barrel. Precise nail placement is attained when the fasteners travel a consistent path through the nosepiece. Reduction of rotation of the nail results in better nail control, allowing more accurate nail placement.

The problem of accuracy when using short fasteners is addressed in U.S. Pat. No. 6,279,808 to Larsen, herein incorporated by reference. Larsen discloses a two-piece nail gun guide having a biased arm that protrudes into the barrel, exerting a force on each nail as the nail travels down the barrel and passes by the arm. The biasing force of the arm pushes each nail to one side of the nail gun barrel, increasing the accuracy and consistent orientation of the nail as it exits the barrel. However, this mechanism exerts the biasing force on the fastener as it exits the nosepiece, not as it enters the barrel. It does not prevent jamming of short fasteners due to tumbling as they enter the barrel. Nor does this reference teach or imply that the nail guide serves as an automatic adjustment for fasteners of differing lengths.

Another difficulty with current nosepiece designs is the potential for build-up of collation paper in the barrel. Generally, when the driver blade contacts the fastener, propelling it through the barrel and into the workpiece, the fastener is rapidly torn from the collation paper. The paper may continue to cling to the fastener, or it may remain attached to the subsequent fastener. If portions of the paper are carried through the barrel with the fastener, it will come loose and immediately be dispersed with the fastener penetrates the workpiece. However, sometimes the paper is pushed aside by the fastener and driver blade and remains attached to the next fastener. When this occurs the collation paper can prohibit this next fastener from fully entering the barrel. Firing the tool in this condition results in poor nail control and may result in a jam.

It is an object of the present invention to provide an improved fastener driving tool which adjusts to varying fastener size without requiring manual intervention from the user.

Another object of this invention is to provide an improved fastener driving tool with more accurate placement of short fasteners.

Still another object of this invention is to provide an improved fastener driving tool that reduces jamming of the fastener in the nosepiece.

Yet another object of this invention is to provide an improved fastener driving tool that allows collation paper to be removed from the barrel of the tool before it jams.

SUMMARY OF THE INVENTION

These and other objects are met or exceeded by the present invention which features a nosepiece and shear block assembly that automatically adjusts the length of the nosepiece barrel to accommodate fasteners of differing sizes.

More specifically, the present invention provides a nosepiece and shear block assembly for a fastening tool that drives a fastener supplied from a plurality of fasteners. The assembly includes a nosepiece that is configured for attachment to the tool and defines a portion of a barrel and a shear block configured to be secured to the nosepiece to complete the barrel. There is an opening in the barrel for receiving a fastener. The assembly also includes a biased fastener-size adjustment device, which exerts a biasing force against fasteners adjacent the opening.

In a preferred embodiment of the invention, the nosepiece and shear block assembly is supplied with fasteners removably attached to a collation tape. At least one window in the nosepiece is aligned with the path of the coalition tape, and permits removal of the tape when the fastener enters the barrel.

The fastener driving tool of the present invention provides automatic adjustment of the opening to the barrel in response to the length of the fastener. Allowing the fastener-size adjustment device, such as a rebound lever, to pivot about a point and biasing it toward the fastener, it automatically adjusts to the fastener length. There is no need for the user to pull on a plunger while attempting to hold on to the tool, rotate the rebound lever, and then release the lever to lock it into the new position. More importantly, the present fastener adjustment feature further eliminates jamming of the tool if the user changes fasteners and forgets to move the position of the rebound lever. The new tool is also particularly useful in operational environments where it is difficult to find a place to rest the tool to effect the change. The present adjustment mechanism provides for continuous size adjustment between a shortest size and the longest fastener that will be accommodated by the barrel opening.

Accuracy of placement for short nails is also improved by the present invention. Movement of the rebound lever to cover the portion of the opening not used by short fasteners prevents them from bouncing off the barrel walls and into the shear block. This provides a straighter path and allows the nails to rotate less within the barrel, allowing for more consistent placement of the nails.

At least one, and preferably a plurality, of windows placed in the nosepiece provides an outlet for the collation tape upon which the fasteners are assembled. If the tape is not expelled with the fastener, the use of windows prevents build-up of tape in the barrel or the nosepiece. Aligning of the windows where the paper tape typically intersects with the portion of the barrel wall allows the tape to exit without accumulating and allows the next nail to entirely enter the barrel of the nosepiece until the nail head and shank makes contact with the surface of the barrel opposite of the opening.

DETAILED DESCRIPTION OF THE DRAWINGS

DETAILED DESCRIPTION OF THE INVENTION

Figure 1:
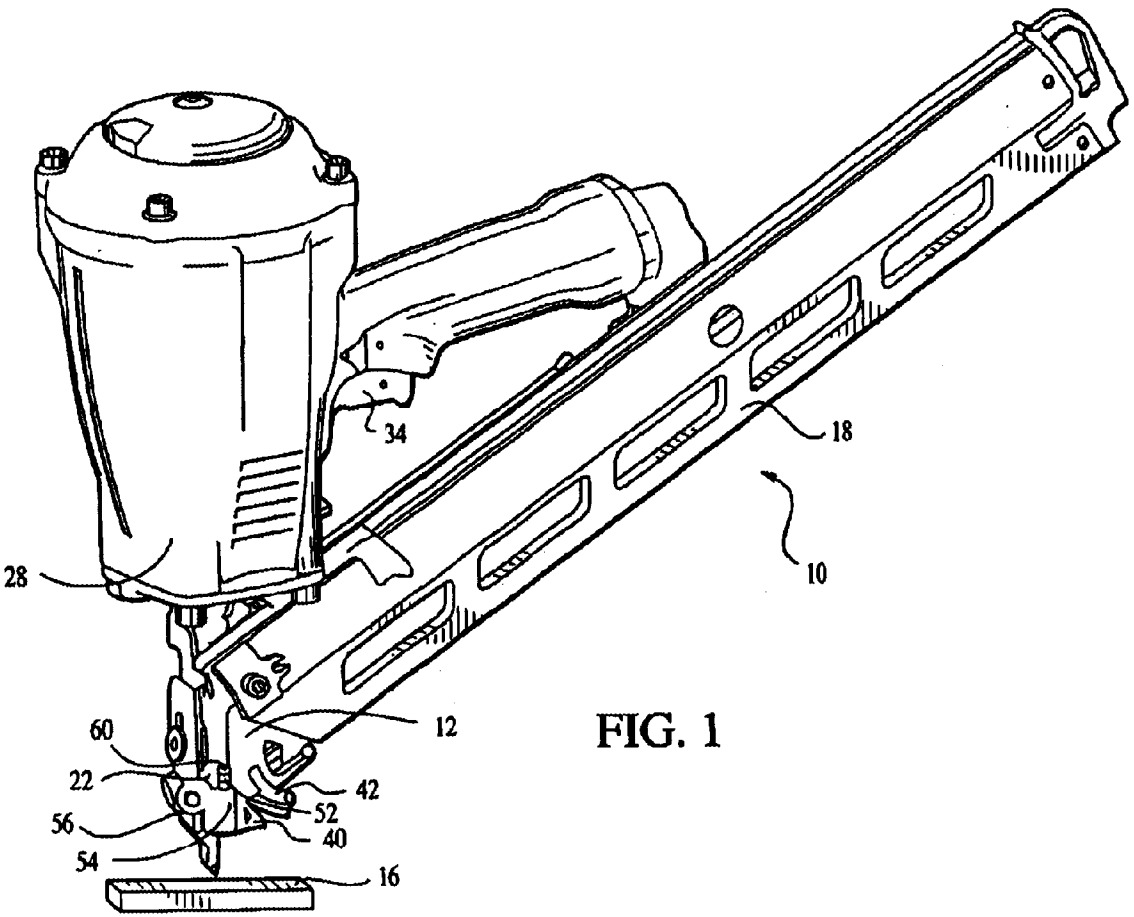
FIG. 1 is a perspective view of the POSITIVE PLACEMENT® tool of the present invention.
Figure 2:
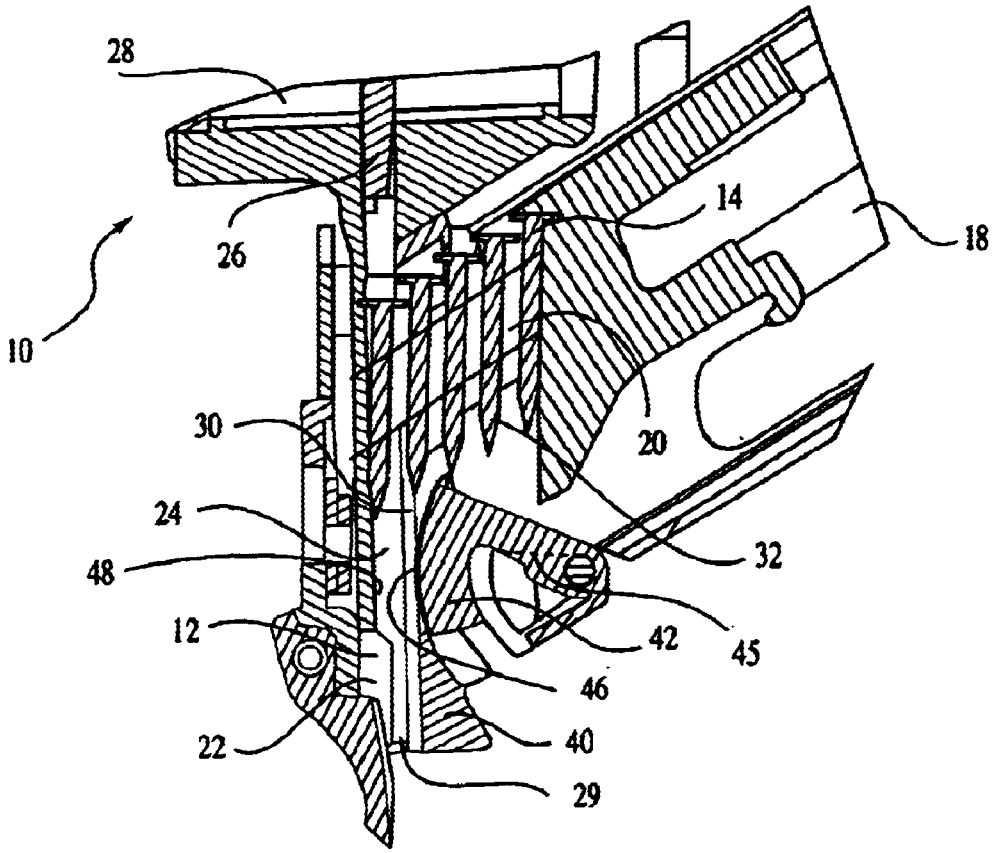
FIG. 2 is a cross sectional view of the nosepiece and shear block assembly and the magazine of the tool of FIG. 1 with short nails loaded.
Figure 3:
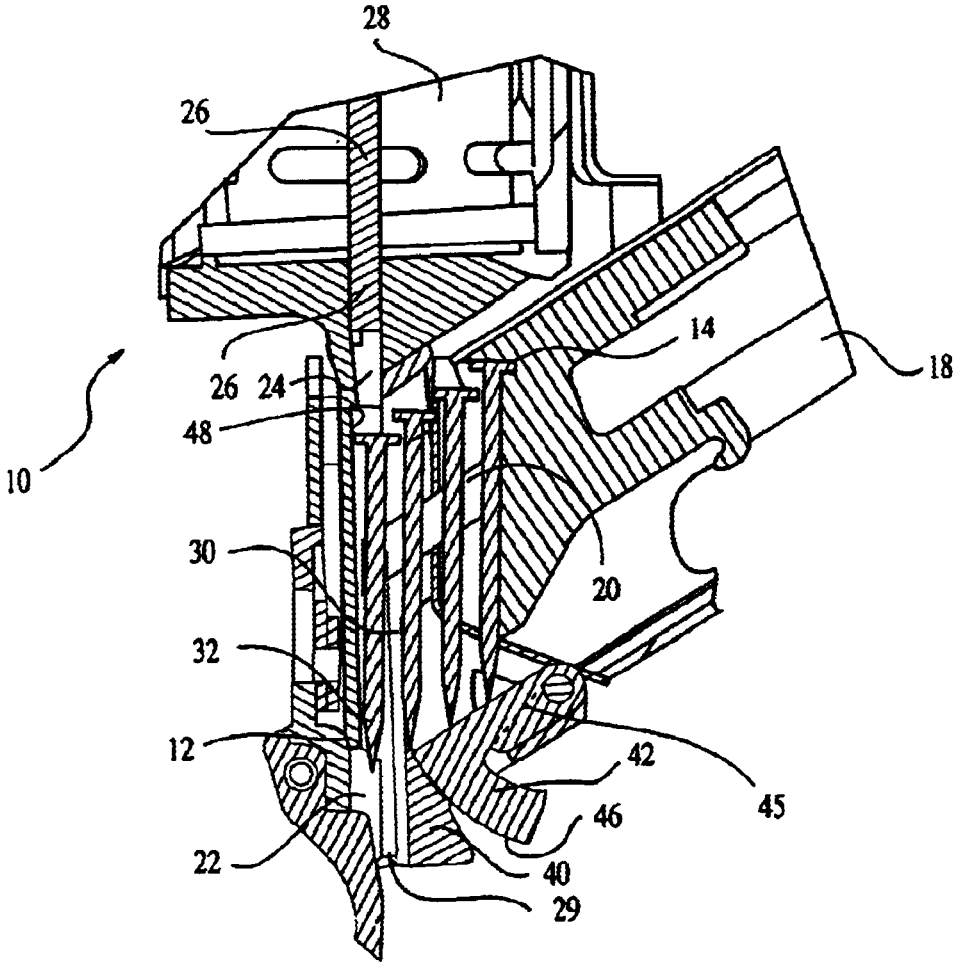
FIG. 3 is a cross sectional view of the assembly of FIG. 2 with long nails loaded.

Referring to FIGS. 1–3, a power tool, generally designated 10, is shown with a nosepiece and shear block assembly 12 having a driver blade. The tool 10 is commonly used for driving a fastener 14 into a workpiece 16, such as in a nailing or framing operation. The fastener 14 is generally loaded into a magazine 18 that is removably attached to the tool 10. The fastener 14 is contemplated as being any type of fastener that is satisfactorily driven into the workpiece 16, such as nails, brads, staples, tacks and the like. To hold a plurality of the fasteners 14 in the same orientation and to handle many fasteners at once, the fasteners are generally attached to a collation tape 20, which is typically made of paper or plastic. The general appearance and the operational details of such power tools 10 are described in greater detail in the patents that have been previously incorporated by reference. Directional references used herein are to be interpreted as if the tool 10 were oriented with a nosepiece 22 approximately perpendicular to and in contact with the workpiece 16, as shown in FIG. 1.

Referring to FIGS. 2 and 3, the assembly 12 includes the nosepiece 22 that is configured for attachment to the tool 10. A tubular barrel 24 is formed at least partially by the nosepiece 22, and guides the fasteners 14 as they are driven into the workpiece 16 by a driver blade 26. The barrel 24 extends from the resting position of the driver blade 26 near a body 28 of the tool 10 to an exit 29 at the surface of the workpiece 16 when the tool 10 is ready to drive the fastener 14. A rear-facing opening 30 in the barrel 24 receives the fastener 14 from the magazine 18 oriented so that a penetrating portion 32 of the fastener 14 is closest to the workpiece 16 and the length of the fastener is generally parallel with the barrel. When the tool 10 is in contact with the workpiece 16 and a trigger 34 (FIG. 1) is activated by the user, the driver blade 26 rapidly travels through the barrel 24. At the opening 30, the driver 26 contacts the fastener 14 and propels it through the remaining length of the barrel 24 and into the workpiece 16.

Figure 4:
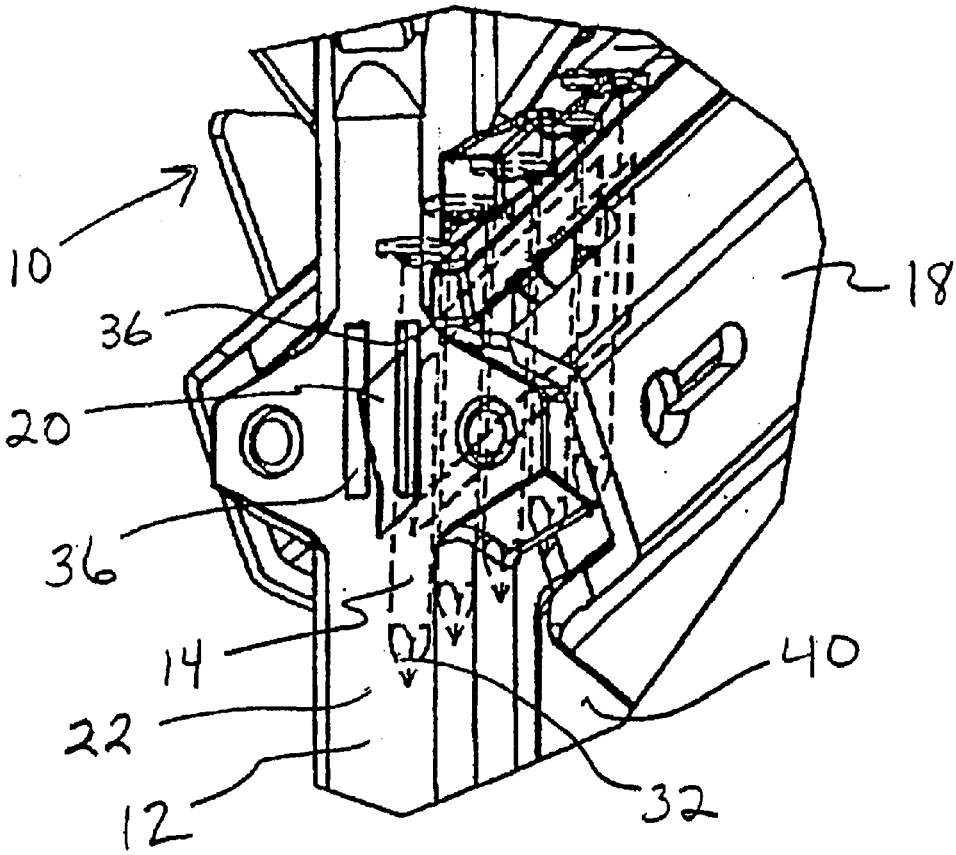
FIG. 4 is a detail of a side elevation of the nosepiece windows with the nail strip shown in phantom.
Figure 7:
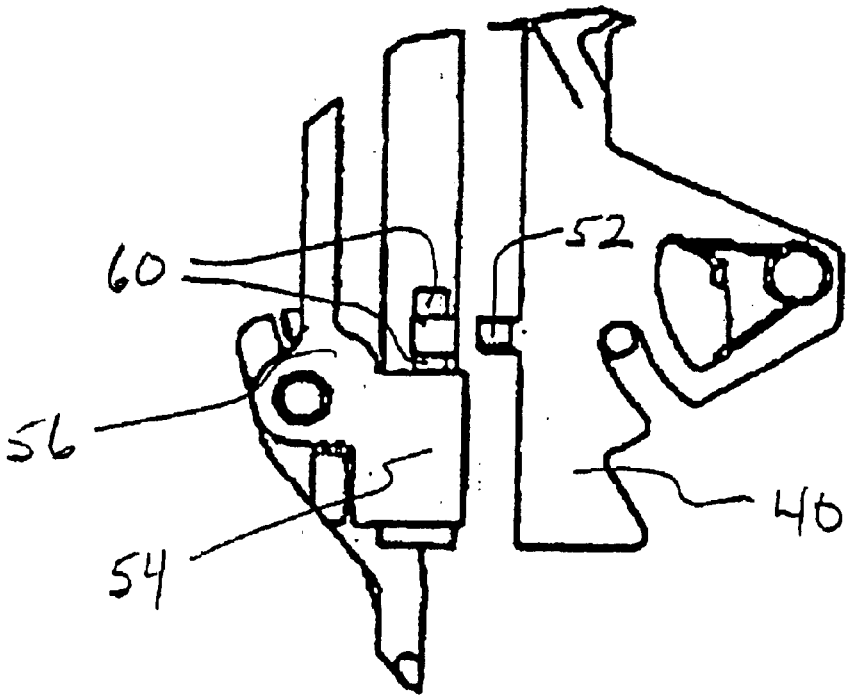
FIG. 7 is a side view of the assembly of FIG. 5 with the shear block separated from the nosepiece.

Optionally, the nosepiece 22 has one or more windows 36 extending to the barrel 24 seen best in FIG. 4. The windows 36 are constructed and arranged to align with the path of the collation tape 20. Any shape window 36 is suitable, although a slot shape is preferred. If the collation tape 20 does not tear off with the previous fastener 14, it is aligned to protrude through the window 36, allowing the next fastener 14 to completely enter the barrel 24. The collation tape 20 is likely to be dispelled by subsequent shots of the tool 10. Occasionally, the collation tape 20 will become folded, bent or otherwise misaligned so that it fails to align with the windows 36, and begins to build-up in the barrel 24. In this case, the windows 36 permit the user to observe the paper 20 build-up and remove the tape 20 before a jam occurs. Access to the barrel 24 is provided to facilitate the clearance of collation tape 20 to jams. Any configuration known in the art for providing access to the barrel 24 is useful with this invention. One preferable assembly 12 has the barrel 24 formed partially by the nosepiece 22 and partially by an adjoining shear block 40 that is configured to be secured to the nosepiece to complete the barrel. An advantage of forming the barrel 24 so that the nosepiece 22 and the shear block 40 are adjacent to and separable from each other, as seen in FIG. 7, is that the assembly 12 is conveniently cleared of jams.

Referring now to FIGS. 2 and 3, the assembly 12 includes a biased fastener-size adjustment device 42. Preferably, the device 42 is in the form of a rebound lever that is pivotally attached to the shear block 40 and is positioned such that the rebound lever pivots in response to the length of the fastener 14. The fasteners 14 move from the magazine 18 into the opening 30 in the barrel 24, oriented approximately vertically. The length of the opening 30 is at least as long as the longest fastener 14 that is intended to be used in tool 10. As the long fasteners 14 move down the magazine 18 toward the opening 30, a penetrating end 32 of the fastener 14 contacts the rebound lever 42. The rebound lever 42 is biased, as with a spring 45 (shown hidden) urging it upward as shown in FIG. 2, to press it against the fasteners 14. The fasteners 14 push downwardly against the rebound lever 42, pushing it out of the path of the fasteners 14.

One surface of the rebound lever 42 is referred to as a blocking surface 46 since it is to obscure unused portions of the opening 30. The blocking surface 46 is adjacent to the barrel 24 of the tool 10. As the rebound lever 42 pivots up and down with respect to the length of the fasteners 14, the blocking surface 46 changes the effective length of the opening 30 as the rebound lever 42 pivots. The shape of the blocking surface 46 is not critical, however, an arc shape is preferred.

Following the driving of a fastener 14, as the driver blade 26 retracts up the length of the barrel 24 and moves upwardly past the opening 30, the next fastener 14 is pushed into the barrel 24 by the spring-loaded clip or magazine 18. As the tool 10 is fired, the driver blade 26 contacts the fastener 14 and begins to push it down the barrel 24, it has a tendency to bounce or rebound off the wall 48 and begins to exit the barrel through the opening 30. When long nails 14 are loaded, the rebounding nail often hits the next nail in the magazine 18 and is reflected back into the barrel 24. But when short nails 14 are used, they can rotate through the opening 30, partially exiting the barrel 24 below the end of the next fastener 14. The blocking of the opening 30 by the blocking surface 46 between the bottom of the fastener 14 and the bottom of the opening keeps the fastener inside the barrel 24 even if it rebounds.

When it is desired to change to smaller nails 14, the improved nosepiece and shear block assembly 12 allows the tool 10 to adjust automatically to the different length fastener. As short fasteners 14 pass through the magazine 18, they do not cause the rebound lever 42 to rotate as much as the long nails. Compared to the long nails 14, the biasing force of the spring 45 is not overcome, and rebound lever 42 is not depressed as far by the short nails, so that more of the blocking surface 46 adjoining the barrel 24 closes off the unused portion of the opening 30. When the short nail 14 rebounds off of the wall 48, it encounters the blocking surface 46 instead of entering the shear block 40, and is deflected back into the barrel 24. Reducing the effect of rebound is particularly advantageous on a POSITIVE PLACEMENT® tool 10 as the fastener 14 is urged along a straighter path through the barrel 24, improving the accuracy of its placement.

When the clip or magazine 18 is changed or refilled with an additional supply of fasteners 14, the rebound lever 42 automatically adjusts to the length of the newly loaded fasteners. The fasteners 14 push the rebound lever 42 sufficiently out of the way to allow them to pass by unimpeded, while the biasing force provided by the spring 45 pushes the rebound lever 42 upward to contact the penetrating tip 32 of the fastener 14, closing the unused portion of the opening 30. Regardless of the length of the fastener 14, the rebound lever 42 pivots to contact the penetrating tip 32.

Referring to FIG. 7, some tools 10 of this type have a quick clearing feature whereby the nosepiece 22 easily separates from the shear block 40 by operation of a latch (not shown). This feature is used to quickly open the barrel 24 of the tool 10 to clear a jam and close the barrel again without having multiple parts to disassemble. Such features are well known in the art. Forces in play during firing tend to push against the barrel 24 walls, trying to push apart the nosepiece 22 and shear block 40. Where the nosepiece 22 and the shear block 40 are separable, stress is placed on the latch mechanism or other apparatus normally holding the nosepiece 22 and shear block 40 together. If the latch is worn after a great deal of use, it could possibly disengage during firing, allowing the nosepiece 22 and the shear block 40 to fly apart.

Figure 5:
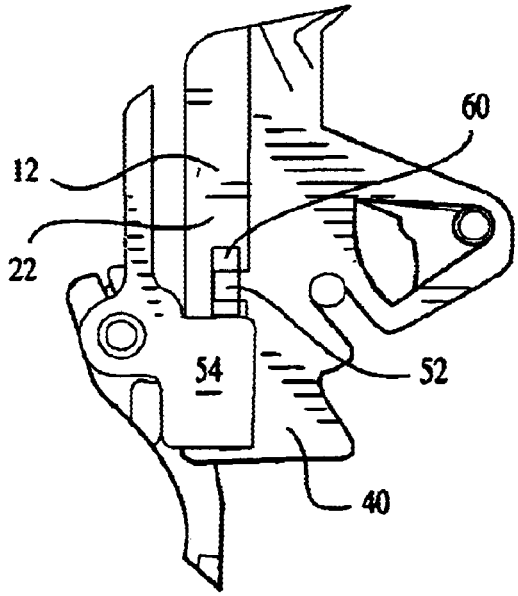
FIG. 5 is a detail side view of the nosepiece and shear block assembly having the workpiece contact element and the cap disengaged from a plurality of bosses.

The possibility of latch failure is minimized by incorporating at least one boss 52 on the shear block 40 that matingly engages a raised cap 54 on a movable element 56, such as a workpiece contact element. When in its lower or resting position, as shown in FIG. 5, the workpiece contact element 56 interlocks with the firing mechanism (not shown) to assure that the tool 10 does not fire unless in contact with the workpiece 16. In this position, the nosepiece and shear block are separable, allowing the user to clear a jam if needed. As the workpiece contact element 56 is pushed upward, in a motion parallel to the length of the barrel 24 to a firing position shown in FIG. 6, the workpiece contact element 56 engages the shear block 40 as described in more detail below. This position allows the tool 10 to fire but prohibits separation of the nosepiece 22 and shear block 40. The workpiece contact element 56 is preferably spring biased to automatically return to its resting position when the tool 10 is lifted from the surface of the workpiece 16. After firing of the tool 10, the firing mechanism is locked out until activated again by engagement of the workpiece contact element 56.

Figure 6:
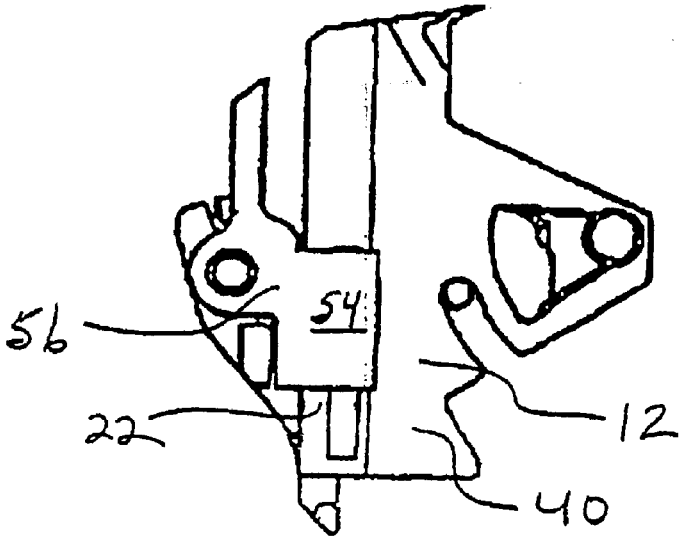
FIG. 6 is a side view of the assembly of FIG. 5 having the cap engaged with a plurality of bosses.
Figure 8:
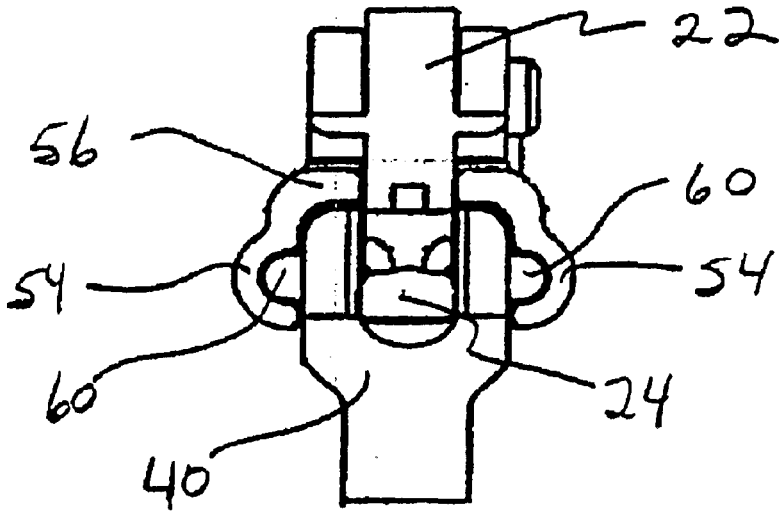
FIG. 8 is a bottom view of the assembly of FIG. 5.

The raised cap 54 is designed to easily move over the boss 52 in a direction that is parallel to the barrel 24, but to prevent movement that would allow separation of the nosepiece 22 from the shear block 40. As shown in FIG. 8, the boss 52 has a cross section that is generally semi-circular, but other cross sectional shapes, such as triangles, rectangles and the like are also suitable. When the workpiece contact element 56 moves upward in response to placement of the tool 10 on the workpiece 16, the cap 54 slides over the boss 52 as seen in FIG. 6. FIG. 7 shows disengagement of the tool 10 from the workpiece 16 that also disengages the cap 54 from the boss 52, allowing quick separation of the nosepiece and shear block assembly 12. Thus, the nosepiece 22 and the shear block 40 cannot accidentally separate during firing of the tool 10 and a jam can be cleared only when the tool 10 is disabled from firing.

Still referring to FIGS. 5, 6 and 7, the shear block 40 optionally has one or more of the bosses 52 also referred to as first bosses, and the nosepiece 22 has one or more second bosses 60. Although the use of multiple caps 54 is contemplated, an economical embodiment uses a single cap to engage multiple bosses 52, 60 that are arranged linearly and coaxially. The bosses 52, 60 are preferably arranged so that both of them are covered by, and can engage the cap 54 of the workpiece contact element 56 when it is engaged with the workpiece 16. The use of additional devices to further secure the cap 54 and the bosses 52, 60 are contemplated, such as a flange on the cap engaging a slot on the boss, or a pin inside the cap that engages a bore through the boss. The most preferred arrangement includes two bosses 60 on the nosepiece 22 and at least one boss 52 on the shear block 40, shown in FIGS. 1, 5, 7 and 8.

While a particular embodiment of the present nosepiece and shear block assembly has been shown and described, it will be appreciated by those skilled in the art that changes and modifications may be made thereto without departing from the invention in its broader aspects and as set forth in the following claims.

What is claimed is:

1. A nosepiece and shear block assembly for a fastening tool that drives a fastener supplied from a plurality of fasteners, comprising:

a nosepiece being configured for attachment to the tool and defining a portion of a barrel;

a shear block configured to be secured to said nosepiece and complete said barrel;

said barrel having an opening for receiving the fastener; and an automatic, biased fastener-size adjustment device configured to exert a biasing force against the fastener adjacent said opening.

2. The assembly of claim 1 wherein said fastener-size adjustment device obscures unused portions of said opening.

3. The assembly of claim 1 wherein said opening receives the fastener oriented with the length of the fastener being generally parallel with said barrel.

4. The assembly of claim 1 wherein said fastener-size adjustment device comprises a rebound lever.

5. The assembly of claim 4 wherein said fastener-size adjustment device is pivotally attached to said shear block.

6. The assembly of claim 1 wherein said fastener-size adjustment device further comprises a spring.

7. The assembly of claim 1, wherein said shear block further comprises a first boss, said nosepiece further comprises a workpiece contact element slidingly attached thereto and having at least one cap, and wherein said cap is configured to engage said first boss when said workpiece contact element engages a workpiece.

8. The assembly of claim 7 wherein said shear block further comprises a second boss configured to be engageable by said cap.

9. The assembly of claim 8 wherein said first boss and said second boss are arranged linearly and coaxially.

10. A nosepiece and shear block assembly for a fastening tool that drives a fastener supplied from a plurality of fasteners, comprising:

a nosepiece being configured for attachment to the tool and defining a portion of a barrel, wherein said fasteners are supplied removably attached to a collation tape and wherein said nosepiece comprises a plurality of windows through said nosepiece; said windows aligning with the path of the coalition tape and permitting removal of the tape when the fastener enters said barrel;

a shear block configured to be secured to said nosepiece and complete said barrel;

said barrel having an opening for receiving a fastener; and said assembly including a biased fastener-size adjustment device which exerts a biasing force against fasteners adjacent said opening.

11. The assembly of claim 10 wherein said fastener-size adjustment device obscures unused portions of said opening.

12. The assembly of claim 10 wherein said fastener-size adjustment device comprises a rebound lever.

13. The assembly of claim 10 wherein said biasing force comprises a spring.

* * * * *